US005778494A

United States Patent [19]

Freund et al.

[11] Patent Number: 5,778,494

[45] Date of Patent: Jul. 14, 1998

[54] METHOD AND APPARATUS FOR IMPROVING THE AIR FLOW THROUGH AN AIR DUCT IN A DRY FIBER WEB FORMING SYSTEM

[75] Inventors: Kenneth Stephen Freund, Gallatin; Andrew James Giles, Joelton; Todd Arden McCoy, Hendersonville; Lyles Howard Sowell, Old Hickory; Phillip Osborne Staples, Nashville; Leonard Ray Tucker, Hendersonville, all of Tenn.; James Stephen Bailey, Arlington, Va.

[73] Assignee: E. I. du Pont de Nemours and Company, Wilmington, Del.

[21] Appl. No.: 760,129

[22] Filed: Dec. 3, 1996

Related U.S. Application Data

[60] Provisional application No. 60/008,368, Dec. 8, 1995.

[51] Int. Cl.[6] ..... D01G 25/00

[52] U.S. Cl. ..... 19/304; 19/296

[58] Field of Search ..... 19/296, 297, 298, 19/299, 300, 302, 303, 304, 305, 306, 307, 308

[56] References Cited

U.S. PATENT DOCUMENTS

| | | | |
|---|---|---|---|
| 3,641,628 | 2/1972 | Fehrer | 19/156.4 |
| 3,740,797 | 6/1973 | Farrington | 19/306 |
| 3,797,074 | 3/1974 | Zafiroglu | 19/156.3 |
| 3,895,089 | 7/1975 | Goyal | 19/306 |
| 3,914,822 | 10/1975 | Wood | 19/306 |
| 3,932,915 | 1/1976 | Contractor et al. | 19/156.3 |
| 4,097,965 | 7/1978 | Gotchel et al. | 19/306 |
| 4,130,915 | 12/1978 | Gotchel et al. | 19/304 |
| 4,475,271 | 10/1984 | Lovgren et al. | 19/105 |
| 4,701,294 | 10/1987 | Radwanski et al. | 264/518 |

FOREIGN PATENT DOCUMENTS

| | | |
|---|---|---|
| 0 378 807 | 7/1990 | European Pat. Off. . |
| 0 383 616 | 8/1990 | European Pat. Off. . |
| 2 292 792 | 6/1976 | France . |
| WO 94/02673 | 2/1994 | WIPO . |

*Primary Examiner*—C. D. Crowder
*Assistant Examiner*—Larry D. Worrell, Jr.

[57] ABSTRACT

This invention relates to improved aerodynamics in dry fiber web forming machines and particularly to airlays which form high quality webs. The invention includes a disperser roll for feeding fibers into the air stream and a second roll opposite to the disperser roll for balancing the disruptive effects of long stationary walls and rotating members in the air duct. In one alternative arrangement of the invention, the fibers are also fed to the air stream by a second disperser roll opposite the first disperser roll.

29 Claims, 4 Drawing Sheets

METHOD AND APPARATUS FOR IMPROVING THE AIR FLOW THROUGH AN AIR DUCT IN A DRY FIBER WEB FORMING SYSTEM

This application claims the benefit of U.S. Provisional application No. 60/008,368, filed Dec. 8, 1995.

FIELD OF THE INVENTION

This invention relates to webs formed of generally randomly oriented fibers and more particularly to the aerodynamics of the air and fiber passing through a duct leading to the consolidation screen where the web is formed.

BACKGROUND OF THE INVENTION

E. I. du Pont de Nemours and Company (DuPont®) has been making Sontara® spunlaced fabric for a number of years. The process includes disassembling a batt of fiber into individualized fibers and laying the fibers down as a web on a screen conveyor belt. The process is disclosed in U.S. Pat. No. 3,797,074 to Zafiroglu issued on 19 Mar. 1974 and such disclosure is incorporated herein by reference. One of the ever present problems with making Sontara® spunlaced fabrics is the extreme sensitivity of the individual fiber filaments to any minor flow of air and deviations in the air flows such as eddies, vortices, and turbulence, etc. Probably one of the most troubling places for any kind of turbulence, vortices or eddies to form is in the air duct where the air and fibers are being carried to the screen consolidation belt to form the web.

The air stream in the air duct of an airlay has fairly particular standards for receiving the doffed fiber and carrying it to the belt for forming the web. The air stream must have a velocity within a particular range relative to the disperser roll and it must be substantially free of turbulence and vortices. To provide such a particular air stream, the air is filtered and linearized to have minimal turbulence. The filtering and especially the linearizing have been found to be best accomplished at a velocity much slower than the doffing speed. Thus, the air stream is linearized and filtered at a low speed and accelerated by directing the airstream into a smaller dimension duct without substantially inducing or creating turbulence or vortices. Regardless of how well this is accomplished, the generally linear, non-turbulent air stream is unstable and will eventually develop excessive and unacceptable turbulence along the peripheral walls of the duct. Thus, the object of the process designers is to get the fiber off the roll and onto the screen consolidation belt before the eddies and turbulence reach magnitude that causes defects and irregularities in the web.

Referring to FIG. 1, a conventional airlay is generally indicated by the reference number 10. The airlay 10 comprises a disperser roll 20 which rotates in the clockwise direction. The disperser roll 20 includes teeth around the peripheral surface thereof and picks fibers from a batt B at feed rolls 22 and 23. The fiber is carried around from the feed rolls 22 and 23 under a disperser shroud 30 to an air duct 40. The air duct 40 is comprised of bottom wall 42, top wall 44 and side walls (not shown). The duct 40 is arranged to extend generally tangential with a portion of the peripheral surface of the disperser roll 20 and be open at the bottom wall 42 to a portion of the surface of the disperser roll 20. A fan (not shown) creates a stream of air down through the air duct 40 so as to pass along or over the surface of the disperser roll 20. The fibers on the roll centrifugally doff from the teeth on the disperser roll 20 into the air stream over doffing bar 41. The air and fiber move down the air duct to the screen consolidation belt 50. Positioned below the belt 50 is a vacuum duct 60 to pull air through the belt 50 that carried the fibers to the belt and also to pin the fibers to the belt 50.

Of particular importance and interest in FIG. 1 are a series of speed or velocity profile curves generally representing the speed of the air moving down the air duct 40. The first speed curves 71 and 72 are near the top of the air duct 40 and show that the air flow is symmetrical across the duct 40 with a slightly slower movement along the opposite walls 42 and 44, as one would expect. However, as the air stream moves past the disperser roll 20, it changes character. Apparently, the rotating disperser roll 20 creates a boundary layer of air moving along therewith at about the surface speed of the disperser roll 20. At least a portion of the boundary layer is separated by the doffing bar 41 to carry the doffed fiber down the air duct 40. The boundary layer and the air stream interact such that the speed profiles of the air stream at portions downstream of the doffing bar 41 are distorted to favor the bottom wall 42.

Each of the successive speed profile curves 73, 74, 75 and 76 show the fastest portion of the air stream to be closer to the bottom wall 42 and away from the top wall 44. Also present in the duct 40 is a turbulent zone indicated as a vortex 77 along the top wall 44 of the duct 40. The beginning of the turbulent zone 77 varies with a number of factors and grows in thickness towards the end of the duct 40. In practice, the airlay 10 has been operated to direct a majority of the fibers into the faster moving air adjacent the bottom wall 42 so as to avoid the turbulent zone 77 as much as possible. However, some fibers are inevitably carried into the turbulent zone and the turbulent air does cause irregularities and splotchiness in the web.

Accordingly, it is an object of the present invention to overcome the above noted drawbacks and limitations of the prior art and provide an improved process and system for making webs of airlayed fibers.

It is a more particular object to provide a method and apparatus for improving the aerodynamics within the air duct of a machine for laying fibers into a web.

SUMMARY OF THE INVENTION

The above and other objects of the invention are accomplished by a web forming process which comprises dispersing fibers from a rotating disperser roll into an air stream within the air duct and directing the fibers and air stream to a consolidation screen to form a web of randomly oriented fibers. The disperser roll is arranged generally adjacent to the air duct and a rotating roll is positioned generally adjacent and generally across the air duct from the disperser roll to provide a balancing effect on the air stream in the air duct which at least partially offsets the unbalancing effects of the disperser roll.

The invention may also be summarized as an apparatus for forming a web of generally randomly oriented fibers including a rotatable disperser roll having a plurality of teeth around the peripheral surface thereof and arranged to carry fibers on the teeth. A drive unit is provide for rotating said disperser roll at a speed for centrifugally separating the fiber filaments from the teeth of said disperser roll and an air duct is arranged generally tangential to said peripheral surface of the rotatable disperser roll and open to the peripheral surface of the disperser roll. The apparatus further includes a fan arranged with the air duct to create an air stream to pass along the peripheral surface of the disperser roll and receive the fibers and a consolidation screen is arranged for receiving the air stream and fibers and consolidating the fibers into a web and separating the air stream from the fibers. The apparatus particularly includes an opposed rotatable roll arranged generally opposite to the disperser roll across the air duct therefrom to provide a balancing effect on the air stream in the air duct which at least partially offsets the unbalancing effects of the disperser roll and a drive unit associated with said opposed roll to rotate the opposed roll.

BRIEF DESCRIPTION OF THE DRAWINGS

The invention will be more easily understood by a detailed explanation of the invention including drawings. Accordingly, drawings which are particularly suited for explaining the invention are attached herewith; however, it should be understood that such drawings are for explanation only and are not necessarily to scale. The drawings are briefly described as follows.

DETAILED DESCRIPTION OF THE PREFERRED EMBODIMENT

Figure 2:
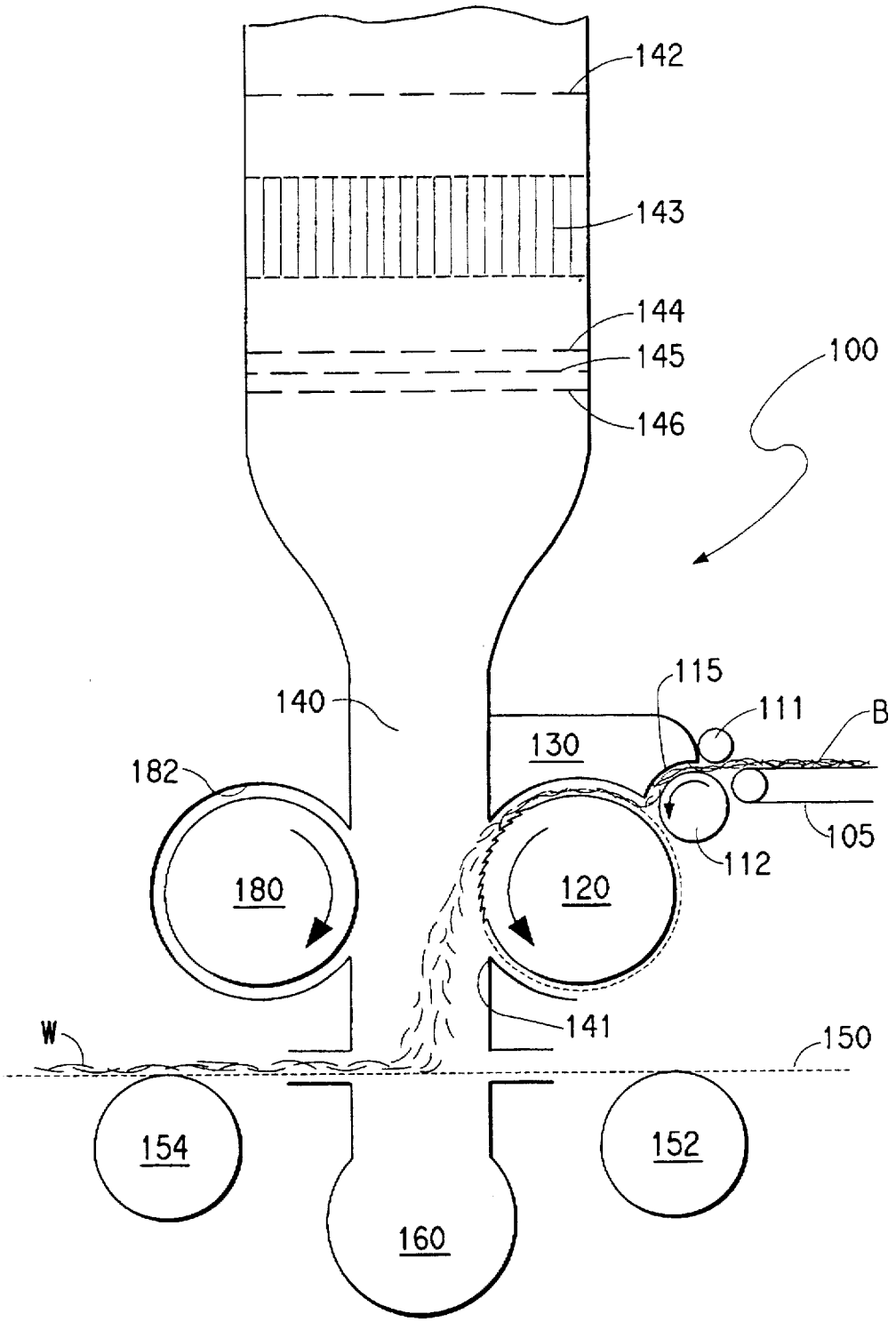
FIG. 2 is a generally schematic elevational view of an airlay of the present invention.

Referring now to the drawings, the invention will be described in greater detail so as to explain the contribution to the art and its application in the industry. Referring specifically to FIG. 2, the airlay is generally indicated by the reference number 100. The airlay 100 receives fiber from a conveyor 105, or other suitable equipment, for carrying fiber usually in the form of a batt B. The batt B is delivered to feed rolls 111 and 112 which deliver the batt B to the disperser roll 120. The disperser roll 120 is mounted by a suitable bearings or other known arrangement to rotate about its axis and is driven at a predetermined rotational speed by suitable drive means (not shown).

In the arrangement as shown, a shoe 115 is used to feed the fiber batt B to the disperser roll 120, such that the batt B is pinched between the feed roll 112 and the shoe 115. Thus, the batt B is held while the disperser roll 120, which has teeth around the peripheral surface thereof, picks fibers from the batt B. It should be understood that there are numerous potential arrangements for providing fiber on a disperser roll and that the invention is not limited to any particular illustrated or described fiber delivery technique. The fiber is carried around from the feed roll 112 and feed shoe 115 under a disperser shroud 130 to an air duct 140.

Figure 3:
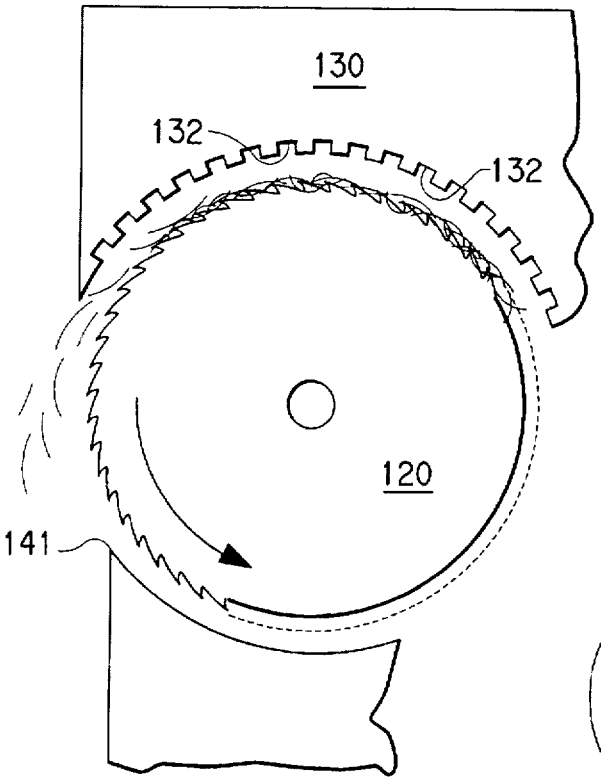
FIG. 3 is an enlarged view of the disperser roll and disperser shroud illustrated in FIG. 2.

Referring to FIG. 3, the disperser shroud 130 is arranged to provide drag on the air around the disperser roll 120 which has the effect of keeping the fibers on the teeth of the disperser roll 120. In particular, the disperser shroud 130 is provided with a series of grooves 132. The grooves form a rough surface which aerodynamically prevents the boundary layer of air around the roll 120 from building very thick. While air is allowed to be carried between the teeth of the disperser roll 120, the air just beyond the tips of the teeth is not permitted to be carried along therewith at the surface speed. As such, the slower moving air in close proximity to the teeth causes drag on the fibers carried on the teeth so as to keep the fibers down close to the surface of the roll 120 and securely carried by the teeth. When the fibers come out from under the shroud 130, the boundary layer quickly builds in conjunction with the air stream in the duct 140 which allows the fibers to project out from the teeth and lift off therefrom to enter the air stream.

The doffing bar 141, which functions like a doctor blade, separates at least a portion of the boundary layer preventing the fibers from re-entraining in the boundary layer following the disperser roll 120 back to the feed rolls 111 and 112. The performance of the doffing bar 141 has been improved by providing a much sharper leading edge as compared to conventional blunt doffing bars. The sharper doffing bar 141 tends to shear the boundary layer of air where the conventional blunt doffing bar tends to have a buildup of air pressure which causes the boundary layer to divide itself. Also, the new doffing bar design collects fewer stray fibers if the air duct side of the doffing bar is co-planar with the remainder of the air duct extending toward the screen consolidation belt 150 and is generally arranged in a plane that is tangential to the peripheral surface of the disperser roll 120 at the base of the teeth thereof.

As shown in FIG. 2, the air duct 140 is arranged to run generally tangential with a portion of the peripheral surface of the disperser roll 120 and be open to the surface of the disperser roll 120. A fan (not shown) or other equipment for creating air flow moves or creates a stream of air down through the air duct 140 so as to pass along or over the surface of the disperser roll 120 and permit the fiber to be centrifugally doffed from the teeth on the disperser roll 120 into the air stream. The air stream is preferably free of turbulence, vortices and eddies, so equipment such as a pre-filter 142, a honeycomb straightener 143 and filters 144, 145 and 146 may be provided to remove or substantially eliminate any such turbulence originating upstream of the air duct 140. Such straightening and linearizing must generally take place at a speed or velocity which is slower than the speed at which the fiber is doffed from the disperser roll 120. Accordingly, the dimension of the duct 140 is reduced downstream of the filters to accelerate the air stream up to the desired speed. This is more particularly described and disclosed in U.S. application No. 08/259,722 and that disclosure is incorporated herein by reference.

As noted above, the fiber on the disperser roll 120 is doffed into the air stream and is carried down the air duct 140 with the air stream to the screen consolidation belt 150. It should be understood that there are a variety of designs for consolidating the fibers into a web including screen belt and screen conveyors and the invention is not limited to any particular consolidation technique. The screen consolidation belt 150 is carried by a series of rollers, or other suitable equipment, including guide rolls 152 and 154. The screen consolidation belt 150 allows the air from the air stream to pass through the belt 150 while the fiber is collected on the upper surface thereof into a web W. The screen consolidation belt 150 is carried along the rolls 152 and 154 at a predetermined rate to continuously form the web W. The thickness or basis weight of the web W is, of course, determined in large part by the rate at which the belt 150 moves under the air duct 140.

Positioned below the belt 150 is a vacuum duct 160. The vacuum duct 160 is associated with a fan, blower or other suitable vacuum source to draw air therefrom thus pulling air down through the belt 150. The vacuum also tends to pin the fiber to the screen consolidation belt 150 helping to consolidate the web W and prevent fiber from blowing off the belt.

Positioned opposite from the disperser roll 120 is an opposed rotating roll 180. The opposed rotating roll 180 rotates concurrently with the disperser roll 120 so as to draw air along the surface thereof down through the air duct 140 in a generally similar manner as the disperser roll 120. The opposed rotating roll 180 is preferably operated to run at about the same rate as the disperser roll 120 and may preferably be geared or belted to the same drive unit (not shown). The term "same rate" is particularly meant to mean that the opposed roll 180 rotates such that it has essentially the same surface speed as the disperser roll 120. If the opposed rotating roll 180 were to have a smaller (or larger) diameter than the disperser roll 120, the rotational speed (e.g. rpm) of the opposed roll 180 would have to be higher (or lower) to maintain the same rate or comparable surface speed with the disperser roll 120.

The opposed rotating roll 180 preferably includes some type of cover such as shroud 182, and may or may not include teeth on the outer surface thereof. Certainly, the object of providing the opposed rotating roll is to provide a balancing effect on the air stream through the air duct 140. Thus, the opposed rotating roll 180 would provide the best balancing effect if it is most similar to the disperser roll 120.

Figure 4:
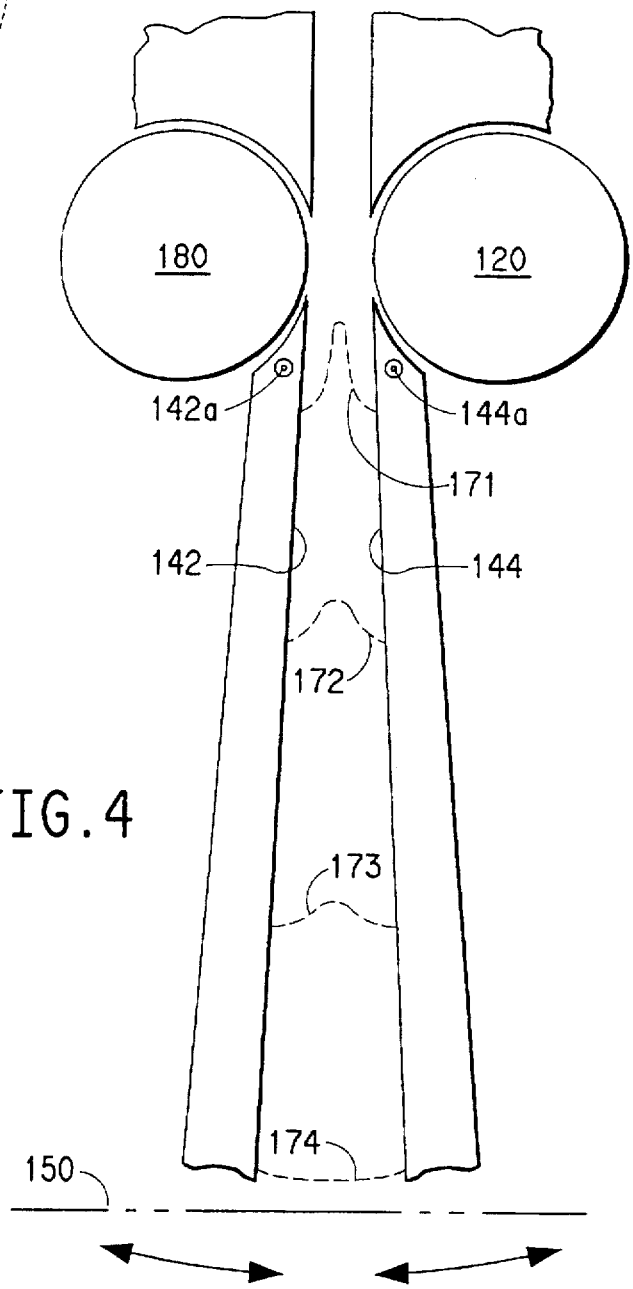
FIG. 4 is an enlarged schematic elevational view of a second embodiment particularly showing the air duct for carrying air and fiber to the consolidation screen conveyor.

Referring now to FIG. 4, the disperser roll 120 and opposed rotating roll 180 are shown in slightly larger and better scale and also arranged in closer proximity. This second embodiment particularly includes hinged walls 142 and 144 defining the lower portions of the air duct 140. The opposite side walls are not shown, but as may be understood by one skilled in the suitable mechanical arts to comprise any suitable arrangement which allows movement of the walls 142 and 144 while maintaining a generally closed wall duct. In particular, the walls 142 and 144 are mounted at shafts 142*a* and 144*a*, respectively, so that the ends of the walls 142 and 144 nearest the belt 150 move toward and away from one another to change the width and shape of the air duct 140. The shafts 142*a* and 144*a* may be secured to suitable brackets or supporting structure of the airlay 100. The walls 142 and 144 may be moved about their axes by suitable arrangement including levers, cranks or simple hand power. Once provided in a preferred arrangement, the walls 142 and 144 may be held in place by the friction of the mechanism for moving the walls or by other suitable means such as detents or pins, etc. The upper portion of walls 142 and 144, between the disperser and opposed rolls 120 and 180, are able to move only slightly as the pivot points are near such rolls.

Adjusting the angle of the walls 142 and 144 changes the characteristics of the air stream passing down the duct 140. The wider the spacing, the more the air stream is able to slow down and the broader the area over which the fibers may be deposited on the belt 150 to form the web. On the other hand, if the air stream is allowed to slow down too much, the stream quickly becomes too unstable and turbulence and vortices erupt causing poorly dispersed fibers in the web.

Also shown in FIG. 4 are several speed profile curves shown within the air duct 140. The first speed profile curve 171 is at the upper portion nearest the disperser and opposed rolls 120 and 180. As the air coming down the duct 140 to the rolls is preferably moving at least slightly slower than the surface speed of the disperser and opposed rolls, the air at the walls is actually moving faster than the air stream at the center of the air duct 140. However, with the friction at the stationary walls, the speed of the air nearest the walls 142 and 144 slows down more quickly than the air at the center. This is seen looking at each of the subsequent speed profile curves 172, 173 and 174. Clearly, it would be ideal to obtain a flat speed profile curve similar to the last speed profile curve 174 at the base of the air duct 140. Such an air profile curve 174 is believed to provide a broad distribution of the individual fibers which will create a highly desirable uniform and randomly oriented fibrous web. Since the duct 140 gets larger toward the bottom, the overall air stream will be slowing down prior to the fiber impacting against the belt. A gentler impact is preferred as it is less likely to disturb fibers that are on the belt and undermine or alter the natural random arrangement thereof. Moreover, most fibers are naturally inclined to take an extended shape although there may be some natural curve or crimp to the fiber. If the fibers are slammed to the belt, there is a greater likelihood that the fibers would be collapsed into some type of kinked or convoluted shape that reduces the contribution that such fibers may have otherwise provided to the tensile and other properties of the web and ultimate fabric products.

By the present invention, there are a number of variables and options for seeking the flat speed profile curve for the air stream at the base of the duct 140. The angle and width of the walls 142 and 144 may be adjusted, the relative speeds of the disperser and opposed rolls 120 and 180 may be adjusted, and the speed of the air stream down the air duct 140 may be adjusted. With the proper adjustment of these variables, an optimized air speed profile curve 174 may be obtained for most fiber or fibers being formed into a web by the system of the present invention. Restated in other words, by the present invention, system performance and web quality improvements are now more possible.

Figure 1:
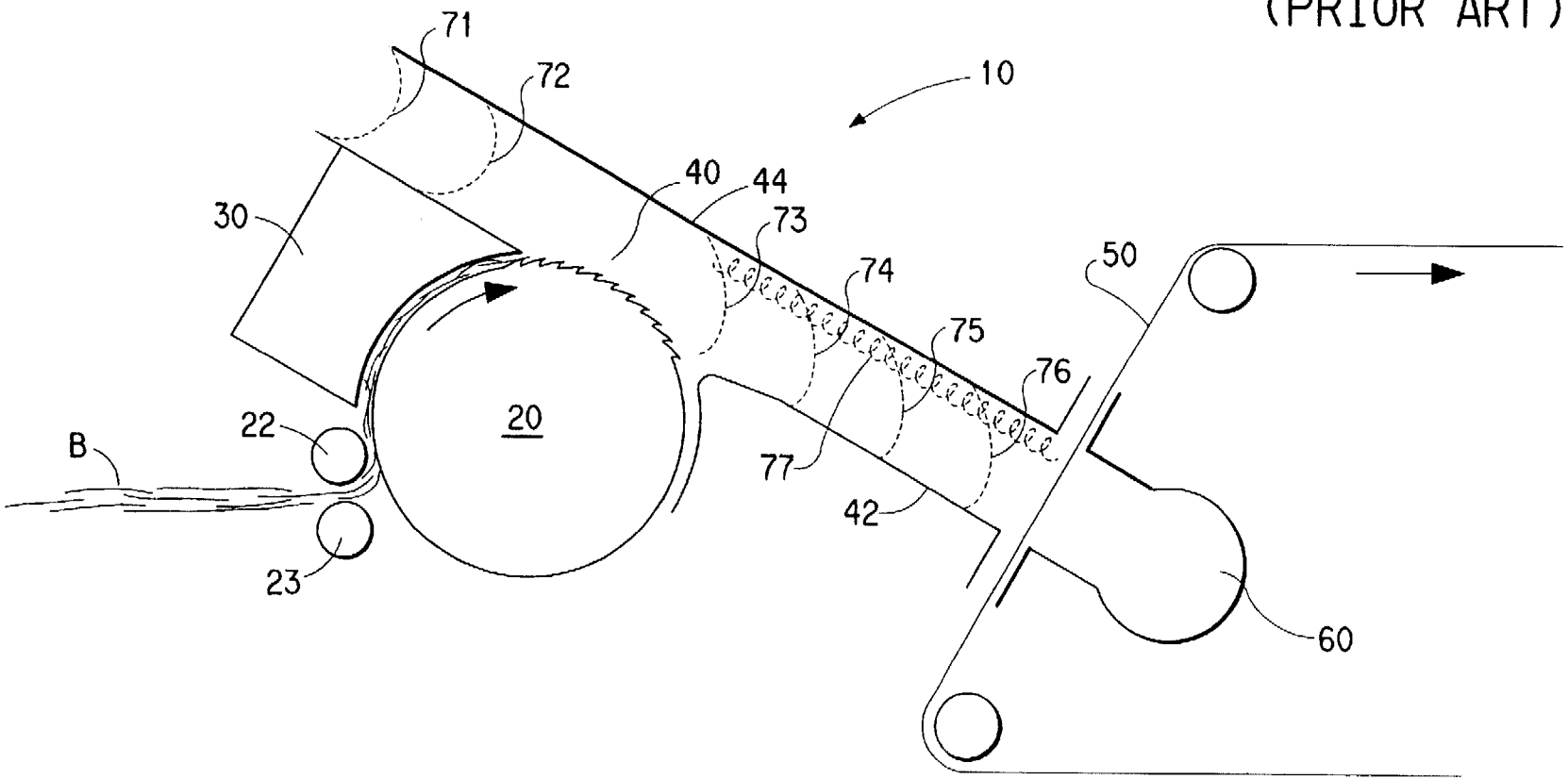
FIG. 1 (PRIOR ART)
FIG. 1 is a generally schematic elevation view of the conventional airlay indicated as prior art.
Figure 5:
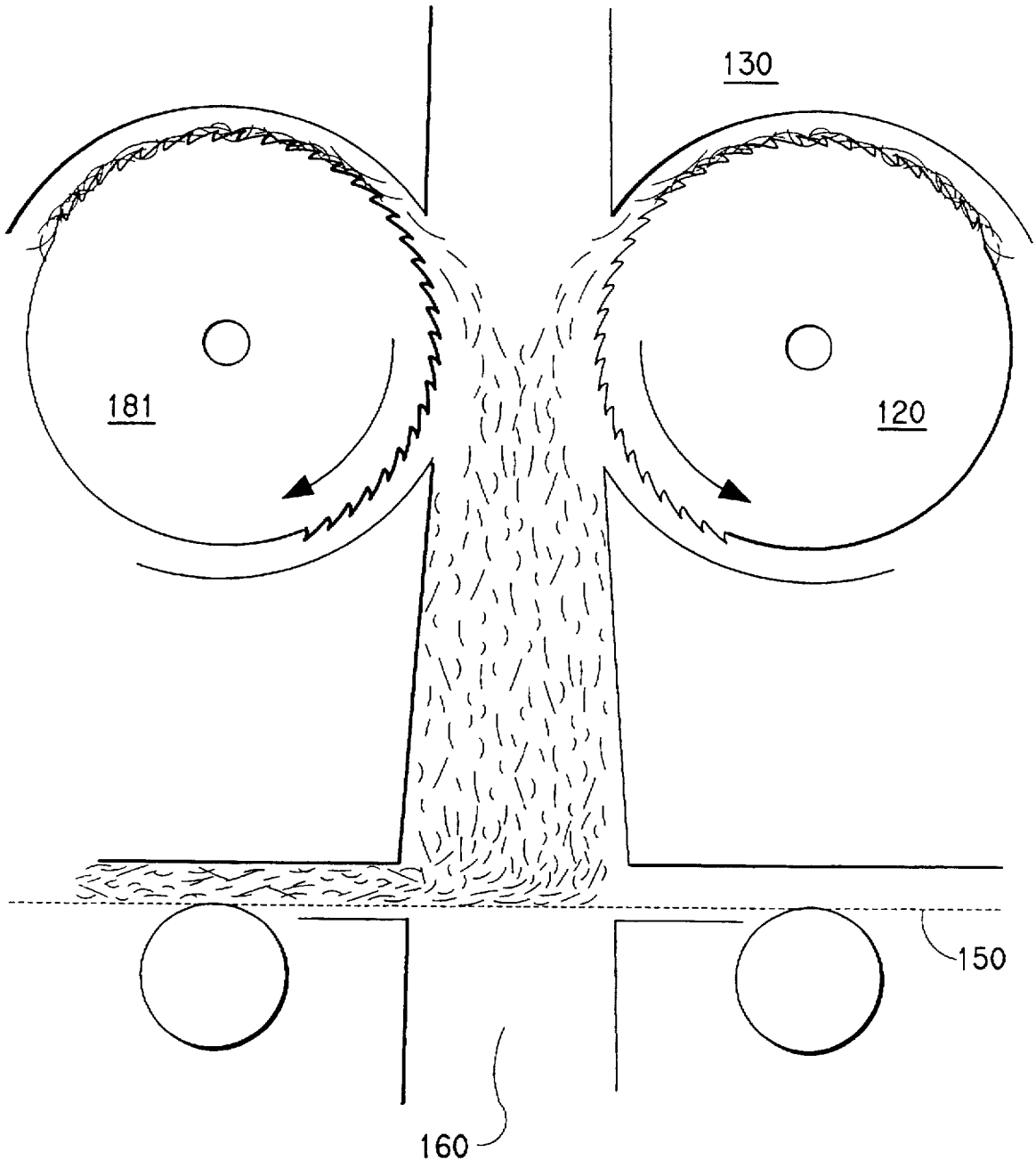
FIG. 5 is an enlarged generally schematic elevational view of a third embodiment of the present invention.

Turning now to FIG. 5 which shows a third embodiment of the invention, the original arrangement has been altered such that the opposed rotating roll 180 is replaced with an opposed disperser roll 181. The opposed disperser roll 181 is provided with a source of fiber to be dispersed into the air stream similar to the first disperser roll 120. The opposed disperser roll 181 may alternatively be provided with a different fiber to be blended with the fiber from the first disperser roll 120. The system would have essentially the same requirements for linearized air and vacuum and the screen consolidation belt, etc. is already provided. As compared to the conventional design in FIG. 1, there may actually be a reduction in the horsepower requirements for the air stream since the opposed disperser roll 181 will induce some flow of air through the duct in conjunction with the first disperser roll 120. As described above relative to driving the opposed rotating roll 180 the drive unit (not shown) for the first disperser roll 120 may also be belted or geared to turn the opposed disperser roll 181.

The foregoing description and drawings were presented to explain the invention and its operation and should not, in any way, limit the scope of coverage that may be afforded by any patent granted from this application. Clearly, the scope of the exclusivity is defined and should be measured and determined by the claims that follow.

We claim:

1. A process for forming a web of generally randomly oriented fibers comprising the steps of:

dispersing fibers from a rotating disperser roll arranged generally adjacent to an air duct into an air stream within the air duct and wherein the rotating disperser roll creates a boundary layer of air which follows the periphery of the rotating disperser roll;

directing the fibers and air stream to a consolidation screen to form a web of randomly oriented fibers on the consolidation screen; and rotating a roll positioned generally adjacent and generally across the air duct from the disperser roll to provide a balancing effect on the air stream in the air duct which at least partially offsets the unbalancing effects of the disperser roll.

2. The process according to claim 1 wherein the step of dispersing fibers more particularly comprises centrifugally doffing fibers from the disperser roll.

3. The process according to claim 1 wherein the step of directing the fibers and air stream further includes drawing air through the consolidation screen with a vacuum duct arranged generally below the screen.

4. The process according to claim 1 further comprising the step of providing drag on the fibers which are carried by teeth on the disperser roll to cause the fibers to remain pinned on to the teeth until the fiber is dispersed into the air duct.

5. The process according to claim 4 wherein the step of providing drag on the fibers more particularly comprises providing aerodynamic drag on the boundary layer of air which follows the periphery of the disperser roll.

6. The process according to claim 1 further comprising the step of at least partially separating the boundary layer of air which follows the periphery of the disperser roll after the fibers are dispersed into the air stream so that the fibers are not re-entrained into the boundary layer.

7. The process according to claim 6 wherein said step of separating at least a portion of the boundary layer further comprises shearing the boundary layer with a relatively sharp leading edge of a doffing bar which is arranged to have a flat surface forming one side of the air duct, and wherein the flat surface is arranged along a plane which is generally tangential with the peripheral surface of the disperser roll at the base of the teeth thereof.

8. The process according to claim 1 wherein the step of rotating a roll to provide a balancing effect more particularly includes rotating a roll of similar size and configuration as the disperser roll at a rotational speed which is generally the same speed as the disperser roll.

9. The process according to claim 1 wherein the step of dispersing fibers into an air stream further includes straightening the air stream to substantially reduce turbulence, vortices and eddies.

10. The process according to claim 1 wherein the step of directing the fibers and air stream to a consolidation screen further includes adjusting the walls of the air duct to change the dimension of the air duct and the velocity profile curve of the air stream.

11. A process for forming a web of generally randomly oriented fibers comprising the steps of:

dispersing fibers from a first rotating disperser roll arranged generally adjacent to an air duct into an air stream within the air duct and wherein the first rotating disperser roll creates a boundary layer of air which follows the periphery of the first rotating disperser roll;

directing the fibers and air stream to a consolidation screen; and dispensing fibers from a second rotating dispenser roll arranged generally adjacent and generally across the air duct from the first disperser roll to provide a balancing effect on the air stream in the air duct which at least partially offsets the unbalancing effects of the first disperser roll.

12. The process according to claim 11 wherein the step of dispersing fibers more particularly comprises centrifugally doffing fibers from the disperser roll.

13. The process according to claim 11 wherein the step of directing the fibers and air stream further includes drawing air through the consolidation screen with a vacuum duct arranged generally below the screen.

14. The process according to claim 11 further comprising the step of providing drag on the fibers which are carried by teeth on the disperser roll to cause the fibers to remain pinned on to the teeth until the fiber is dispersed into the air duct.

15. The process according to claim 14 wherein the step of providing drag on the fibers more particularly comprises providing aerodynamic drag on the boundary layer of air which follows the periphery of the disperser roll.

16. The process according to claim 11 further comprising the step of at least partially separating the boundary layer of air which follows the periphery of the disperser roll after the fibers are dispersed into the air stream so that the fibers are not re-entrained into the boundary layer.

17. The process according to claim 16 wherein said step of separating at least a portion of the boundary layer further comprises shearing the boundary layer with a relatively sharp leading edge of a doffing bar which is arranged to have a flat surface forming one side of the air duct, and wherein the flat surface is arranged along a plane which is generally tangential with the peripheral surface of the disperser roll at the base of the teeth thereof.

18. The process according to claim 11 wherein the step of rotating a roll to provide a balancing effect more particularly includes rotating a roll of similar size and configuration as the disperser roll at a rotational speed which is generally the same speed as the disperser roll.

19. The process according to claim 11 wherein the step of dispersing fibers into an air stream further includes straightening the air stream to substantially reduce turbulence, vortices and eddies.

20. The process according to claim 11 wherein the step of directing the fibers and air stream to a consolidation screen further includes adjusting the walls of the air duct to change the dimension of the air duct and the velocity profile curve of the air stream.

21. The process according to claim 11 wherein the process further includes dispersing different types of fibers from each of the first and second disperser rolls and blending the different fibers in the air duct.

22. An apparatus for forming a web of generally randomly oriented fibers, wherein the apparatus comprises:

a rotatable disperser roll having a plurality of teeth around the peripheral surface thereof and arranged to carry fibers on said teeth; and wherein the rotatable disperser roll creates a boundary layer of air which follows the periphery of the rotatable disperser roll;

a drive unit for rotating said disperser roll at a speed for centrifugally separating the fibers from the teeth of said disperser roll;

an air duct arranged generally tangential to said peripheral surface of said rotatable disperser roll and open to said peripheral surface of said disperser roll;

a fan arranged with the air duct to create an air stream to pass along the peripheral surface of said disperser roll and receive the fibers from said disperser roll;

a consolidation screen for receiving the air stream and fibers and consolidating the fibers into a web and separating the air stream from the fibers;

an opposed rotatable roll arranged generally opposite to said disperser roll across said air duct to provide a balancing effect on the air stream in the air duct which at least partially offsets the unbalancing effects of the disperser roll; and a drive unit associated with said opposed roll to rotate the opposed roll at a speed which provides the balancing effect on the air stream.

23. The apparatus according to claim 22 further including shroud to provide drag on the fibers on the teeth of the disperser roll prior to dispersing the fibers into the air duct.

24. The apparatus according to claim 22 further including a doffing bar arranged at the wall of said air duct just downstream of the disperser roll to separate at least a portion of the boundary layer to prevent the fibers from re-entraining in the boundary layer.

25. The apparatus according to claim 24 wherein said doffing bar has a relatively sharp leading edge to shear the boundary layer of air and includes a relatively flat surface defining a portion of said air duct wherein said flat surface is generally arranged along a plane which is tangential to the surface of said disperser roll at the base of the teeth thereof.

26. The apparatus according to claim 22 wherein said opposed rotating roll has generally the same configuration as said disperser roll.

27. The apparatus according to claim 26 wherein said opposed rotating roll is arranged to disperse fiber into said air duct in a manner similar to said disperser roll.

28. The apparatus according to claim 22 wherein said air duct is defined by opposite walls which are pivot mounted so as to provide for a change in dimension of the air duct between said disperser roll and said consolidation screen.

29. The apparatus according to claim 22 further including a vacuum duct below said consolidation screen for receiving air from said air duct that passes through said screen.

* * * * *